United States Patent [19]

Hurt et al.

[11] 4,058,245

[45] Nov. 15, 1977

[54] YARN CONTROL MECHANISMS AND THE LIKE

[75] Inventors: Francis Neil Hurt, Nottingham; Reginald Theaker, Derby; David Herbert Plant, Nottingham, all of England

[73] Assignee: National Research Development Corporation, London, England

[21] Appl. No.: 728,734

[22] Filed: Sept. 30, 1976

Related U.S. Application Data

[63] Continuation of Ser. No. 553,311, Feb. 26, 1975, abandoned.

[30] Foreign Application Priority Data

Feb. 26, 1974 United Kingdom ..... 08587/74
May 21, 1974 United Kingdom ..... 22763/74

[51] Int. Cl.[2] ..... B65H 17/22

[52] U.S. Cl. ..... 226/174; 226/182; 226/183; 226/195; 242/155 R

[58] Field of Search ..... 226/34, 44, 174, 176, 226/182, 183, 193, 195; 242/153, 154, 155 R

[56] References Cited

U.S. PATENT DOCUMENTS 2,595,270 5/1952 Klein ..... 242/153

2,945,636 7/1960 Lenk ..... 242/153 X

*Primary Examiner*—Richard A. Schacher

*Attorney, Agent, or Firm*—Cushman, Darby & Cushman

[57] ABSTRACT

A rotating yarn control element comprises a hub portion with a number of pins spaced around the periphery of the hub portion to define for the yarn a zig-zag path which degenerates with increasing distance from the axis of rotation of the element into a line path lying in a reference plane of the element. In use, with the element rotating about its axis and the yarn passing through the path defined by the guide surfaces, the total area of contact between the guide surfaces and the yarn will depend on the distance of the yarn from the axis of rotation of the element. This in turn determines whether the element operates in the "freewheeling" mode, the "positive grip" mode or the "yarn metering" mode. Other embodiments are described in which the element is formed by an injection moulding technique and the zig-zag path is presented by tooth like projections or by a channel in a drum member. A means for varying the amount of wrap around the element is also described. The elements can be used to control materials other than yarns although if they are to be used with rigid articles e.g. metal rods or tubes, then the projections presenting the guide surfaces on the element must be made of flexible material.

10 Claims, 15 Drawing Figures

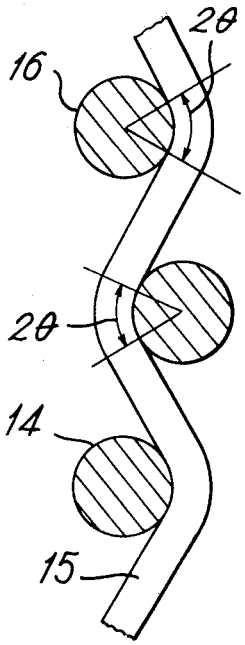
Fig 3
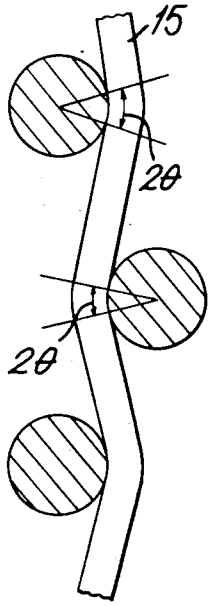
Fig 4
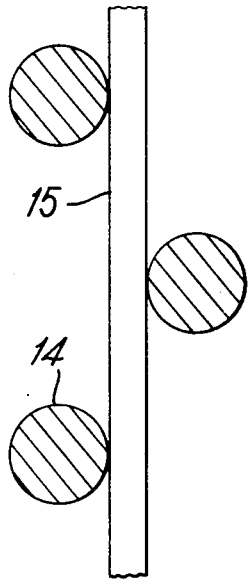
Fig 5
Fig 6
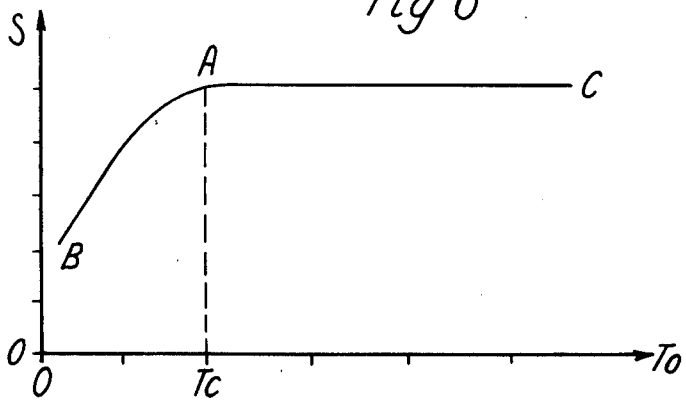

Fig. 8.
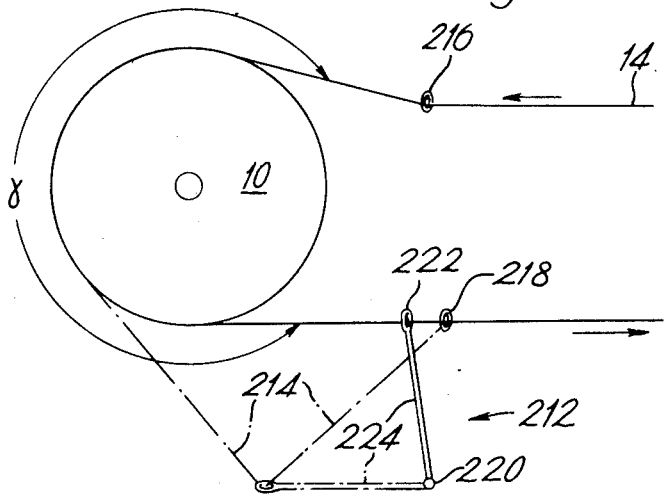
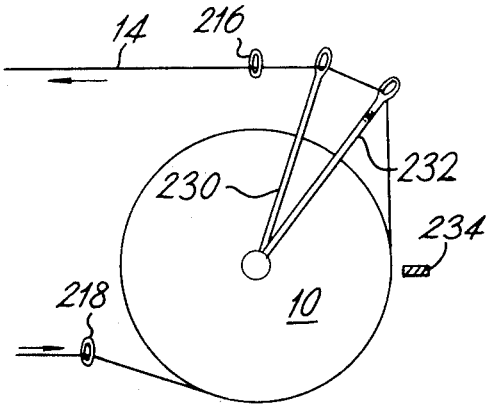
Fig. 9.
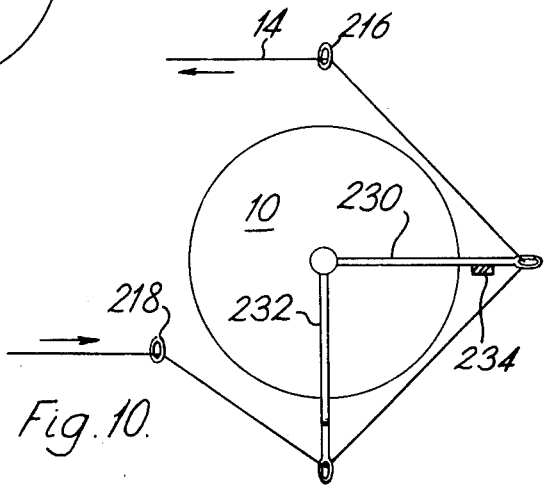
Fig. 10.

YARN CONTROL MECHANISMS AND THE LIKE

This is a continuation of application Ser. No. 553,311 filed Feb. 26, 1975 and now abandoned.

The present invention relates to yarn control mechanisms e.g. for use with industrial knitting machines.

Two types of yarn feed mechanisms are widely used. In one type the yarn is wrapped around a rotating capstan. In the other type the yarn is "nipped" between two moving curved surfaces. The principal disadvantage of both these designs is that the yarn tends to slip in the feed mechanism whenever the tension of the incoming or out-going yarn exceeds certain critical values governed by the surface friction of the capstan or the nip pressure of the surfaces as the case may be. It has been found that if the capstan surface has a higher coefficient of friction, or the nip pressure is increased, to give a firmer grip on the yarn, then other difficulties are introduced. The high friction material on the capstan does not wear well, for example, and gives variable friction effects. The higher nip pressure with the curved surface design, on the other hand, involves unsatisfactorily high levels of component loading and consumption of power for driving these.

A further disadvantage of both known types of feed mechanism is that they cannot conveniently accommodate intermittent feed rates. To do so they would need to switch in and out at a precise point in the knitting cycle and inertia criteria would be critical, both from the point of view of the inertia of the switching mechanism and the inertia of the rotating parts of the feed mechanism.

According to the present invention, a control element for yarn or like material carries at its outer periphery a number of discrete guide surfaces at least in part staggered about an imaginary reference plane which is perpendicular to an axis of rotation of the element, the guide surfaces defining for the material a zig-zag path which degenerates with increasing distance from the axis of rotation of the element into a line path lying in the reference plane of the element.

The guide surfaces may be provided by projections extending from a hub portion of the element. The projections are preferably of circular or part circular cross-section and preferably at least the guide surface portions of alternate projections are inclined, and/or curved, away from the reference plane in the opposite sense.

The projections may take the form of rods ("pins") or "tooth"-like projections.

Alternatively it is envisaged that the guide surfaces might be provided by a drum member with a suitably contoured peripheral surface. Broadly speaking the guide surfaces in this case will take the form of a zig-zag channel widening with increasing distance from the axis of rotation of the control element.

Conveniently the element may be formed using an injection moulding technique.

It will be appreciated that in use with the element rotating about its axis and the yarn or like material passing through the path defined by the guide surfaces, the total area of contact between the guide surfaces and the material will depend on the distance of the material from the axis of rotation of the element. This is because in the absence of the element the material will tend to lie in a line configuration located in what is now the reference plane of the element. Thus when the material is sufficiently distant from the axis of rotation of the element to lie in that part of the path coinciding with the reference plane of the element there is substantially no engagement between the material and the guide surfaces, and the control element is so to speak 'free wheeling.' The closer the material to the axis of rotation of the element, the more zig-zag the path defined by the guide surfaces becomes and hence the greater the guide surface area engaged by the material. Thus the closer the material is to the rotation axis of the element, the greater is the grip of the element on the material and vice versa. This grip is generated by the reaction of the material normal to the guide surface and the frictional coefficients between the yarn areas of contact on the control element. Relative slipping between the material and guide surfaces can, by design, occur when insufficient contact is available, unless, for example, the material tensions are so low as to be unable to provide a sufficient normal force for frictional grip. When the material has slid sufficiently far down the guide surfaces for the frictional grip to be sufficient, then no relative movement can occur between the material and the guide surfaces. This latter situation is referred to as the "positive grip" situation. When the material has slid down to the bottom of the guide surface it will engage with the hub portion, or equivalent part of the element, in addition to engaging the guide surfaces and substantially no movement occurs between the material and the other portions of the control element engaged by the material at the required operating tensions. This is referred to as the "metering" situation.

The position of the material at any given moment will be dependent on the input and output tension of material passing through the control element. Thus assuming a more or less constant input tension, the position of the material will depend only on the feed requirements of the machinery to which the material is being fed. When a control element according to the present invention is designed for use with a particular piece of material-demanding machinery, then the design parameters of the control element are carefully chosen so that when the machinery is working under full load i.e. its demand for material exceeds the supply, material output tensions from the element are consequently high and thus the control element will be working in the positive grip phase. The greater the material demand, the higher the material tension, the greater the perpendicular force, the more positive the grip.

When the machinery is working with a demand less than supply, the material output tension from the device falls and the material will slip relative to the element since the perpendicular force of material to pin is reduced below the positive grip level. In these circumstances and at certain tensions, the material may move up the guide surfaces, reducing the contact angles and increasing the slip. Because the control element never stops rotating or changes its rotational speed, there are no inertial effects to overcome in changing from one material speed to another and so the element responds immediately to any reaction in demand occurring during the operational cycle of the machinery.

An adjustment device may be provided for varying the amount of "wrap" around or within reach of the control element.

One such device comprises a cylindrical bar arranged across the material and manually displaceable, in a direction perpendicular to the direction of movement of the material and to the axis of the bar, to vary the amount of "wrap" around the control element.

Another such device in accordance with the present invention automatically adjusts the length of material within reach of the control element in response to changes in the output tension of material leaving the element. In one embodiment, for example, the adjustment device comprises a guide member for material leaving the control element, the guide member being such that when the output tension of the material is at or in excess of some predetermined preselected "critical" value, the guide member occupies a first position or positions in which it has little or no effect on the path of the material, whereas when the output tension of the material is less than this value, the guide member moves to other positions in which it is more remote from the axis of the control element.

Conveniently the guide member is gravity operated i.e. the weight of the guide member is supported in operation of the control element by material leaving the element when the output tension is at or above the critical value, but falls away under the action of gravity to deflect the material path away from the control element when the output tension falls below this value. The guide member may, for example, comprise a lightweight arm pivotted at its lower end and carrying, at its upper end, an eyelet traversed in operation of the control element by material leaving the element.

The effect of the adjustment means is to encourage material slip relative to the control element in circumstances when material demand is less than the positive feed rate of the control element (i.e. for conditions requiring intermittent positive feed).

Embodiments of the invention will now be described by way of example with reference to the accompanying drawing in which.

Figure 2A:
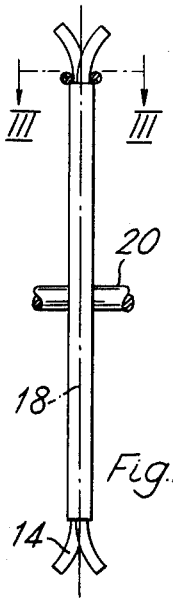
FIG. 2A shows a simplified edge view of the element shown in FIG. 1.
Figure 2B:
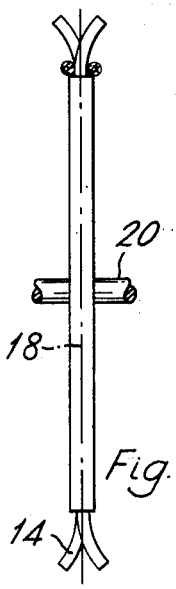
Figure 2C:
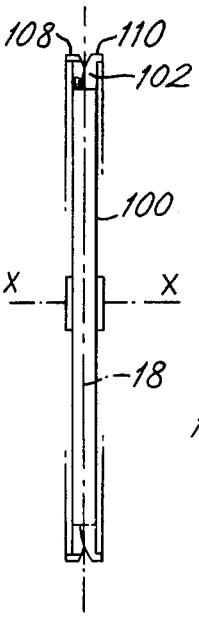
Figure 2D:
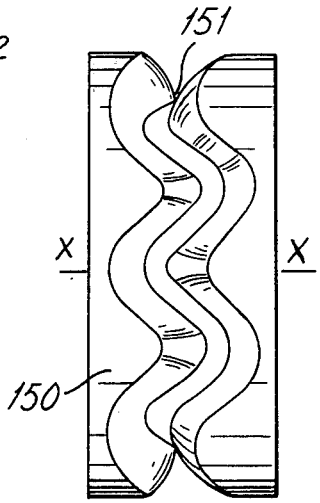

FIGS. 2B, 2C, and 2D show similar views of two alternative forms of element;

FIG. 3 shows, on an enlarged scale, a fragmentary cross-section taken along line III—III in FIG. 2A and illustrating more clearly the way in which the yarn passes through the element;

FIGS. 4 and 5 show sections similar to FIG. 3;

FIG. 6 is a graph illustrating the performance of the element of FIGS. 1 to 2A, and 3 to 5.

Figure 7:
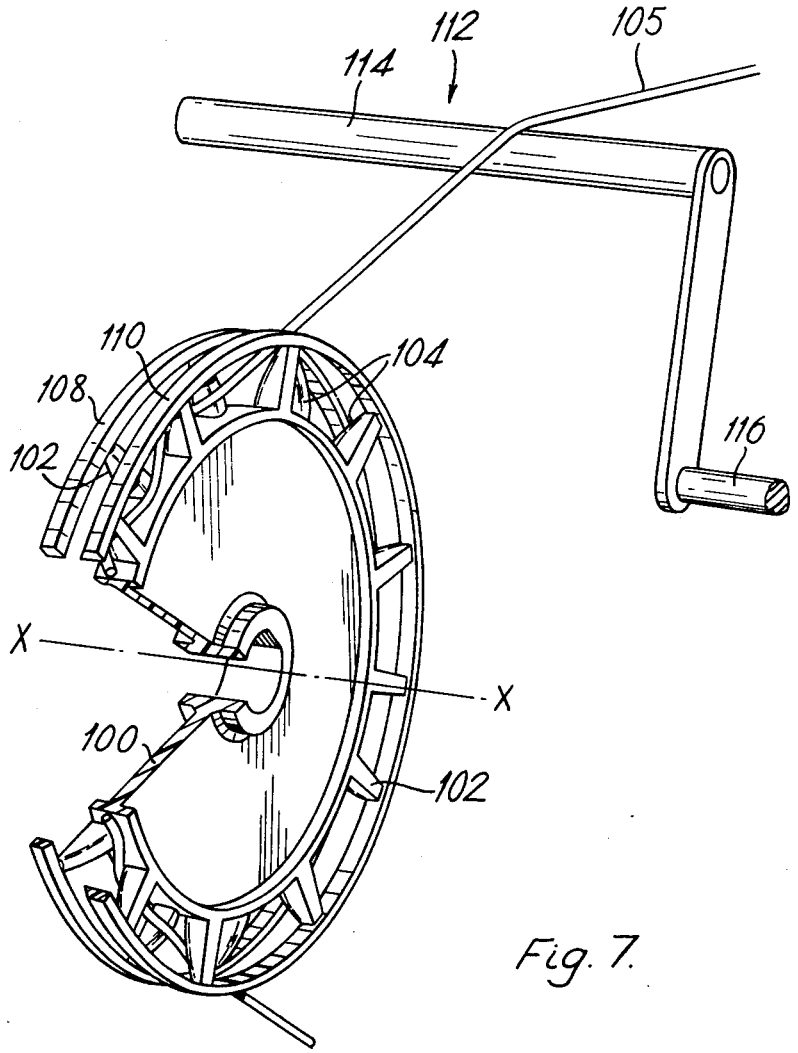

FIG. 7 shows a part cut-away of a particular design of yarn control element formed by an injection moulding technique. This figure also shows a manually controlled adjustment device for varying the amount of wrap around the control element;

FIG. 8 shows a diagrammatic side view of a control element according to the present invention and an automatic adjustment device controlling the length of yarn within reach of the control element. FIGS. 9 and 10 show corresponding views of an alternative design of adjustment device at two different stages of its operation.

Figure 11:
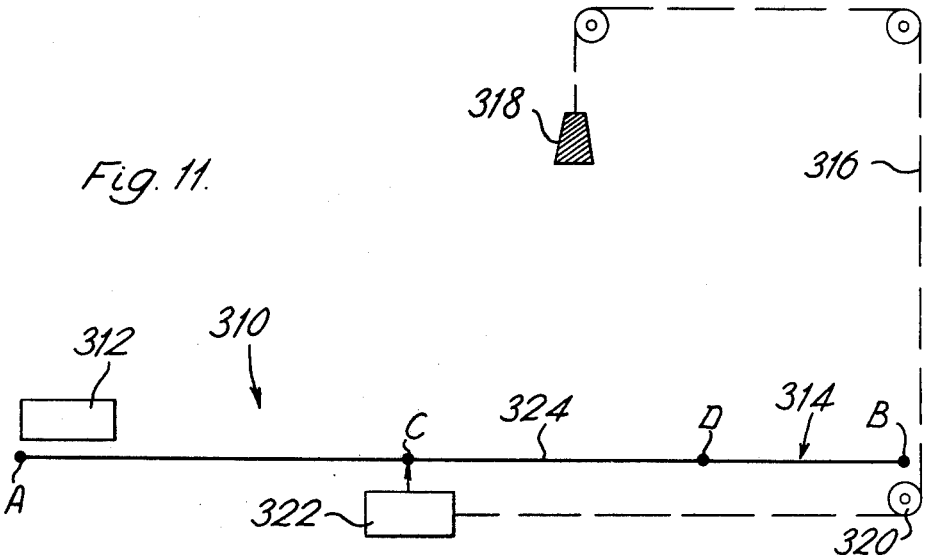
Figure 12:
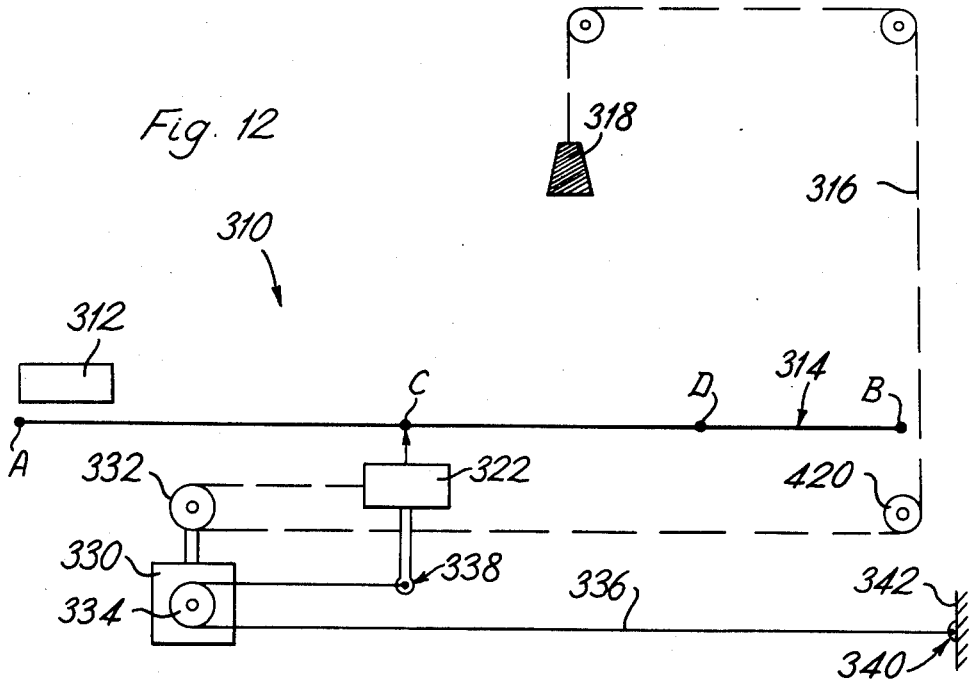

FIG. 11 has been included to show the essential elements of a conventional V-bed knitting machine; and FIG. 12 shows a control element according to the present invention forming part of a yarn feed assembly for such a machine.

Figure 1:
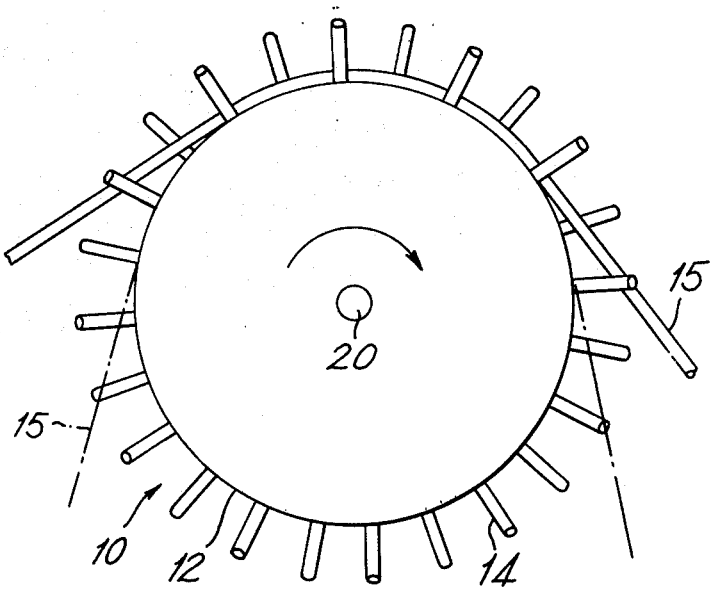
FIG. 1 shows a side view of a yarn control element in accordance with the present invention with the yarn in place around the element.

Referring first to FIGS. 1, 2A and 3, a yarn control element 10 in accordance with the present invention comprises a hub portion 12 with a number of pins 14 spaced around the periphery of hub portion 12. These pins present guide surfaces for yarn 15 constraining it to follow a zig-zag path through the element with a change in direction at each pin 14. As will be most clearly seen from FIG. 3, the root portions 16 of pins 14 may be staggered alternately to one side and to the other side of a reference plane (in this case the mid plane) 18 of hub portion 12.

As best seen from FIG. 2A alternate pins 14 curve away from one side of plane 18 and the intervening pins 14 curve away from the other side. FIGS. 1, 2A, 3 show the positive rate "metering" situation in which the yarn 15 has bedded down between pins 14 to engage the hub portion 12 of the element. Due to the divergence of neighbouring pins 14 (see FIG. 2A) the across-the-plane separation of the guide surfaces provided by the pins increases with the distance from hub portion 12. FIG. 4 is a similar section to that shown in FIG. 3 but taken further along the pins 14 and it illustrates the situation where yarn 15 is located about half-way up pins 14. FIG. 5 is a section taken still further along the pins and it illustrates the "no grip" situation where the yarn passes through the element without any substantial change of direction.

The pins 14 are of circular cross-section and the "angle of wrap" ($\theta$) for each pin is defined (in radians) as the circumferential length of pin engaged by the yarn divided by the pin diameter. Obviously, for any one pin, $\theta$ has a maximum value in the metering situation shown in FIG. 3 and a minimum (zero) value in the "no grip" situation shown in FIG. 5. It will also be clear that FIGS. 3–5 only show the yarn position at the so called "centre" pins i.e. those which at the moment define the central portion of the guide path. In fact although each pin assumes in turn the position shown in FIGS. 3–5, at a given moment the angle the wrap will be different for different pins and in the situation shown in FIG. 1 for example $\theta$ varies from a maximum for the centre pins (shown in FIG. 3) to zero for the endmost pins passed through by the yarn.

Typically on a hub, diameter 50 mm, 24 pins of circular cross-section and diameter 2 mm are equally spaced around its periphery. Each pin is curved away from the central plane on a radius of 10 mm with its root (entering the hub) normal to the peripheral surface.

In operation, the element is externally driven (in a clockwise direction say as viewed in FIG. 1) about a supporting axle 20 through gears e.g. from a knitting machine or by a variable speed motor (not shown). Considering the general case (typified by FIG. 4) where the yarn is some way up the pins, it will be clear that as the element rotates about axle 20 it will introduce a tensioning effect arising from the frictional resistance to relative motion provided by the yarn to pin contact. This resistance is dependent on the coefficient of friction between the yarn and pin and the total guide surface area engaged by the yarn. The latter will in turn be dependent on the number of pins engaged and on the total angle of wrap. In fact the ratio of the tension ($T_o$) of the yarn leaving the element in the general situation to the tension ($T_i$) of the yarn entering the element, is approximately given by the expression:

$$T_o/T_i = e^{2n\mu 1\theta}$$

where $e$ is the exponential function, $n$ is the number of pins engaged by the yarn, $\mu_1$ is the pin/yarn dynamic friction coefficient, and $\theta$ is the angle of wrap at the centre pins.

When the yarn is sufficiently down the pins to be in the positive grip situation this expression no longer applies, however, because relative movement between the yarn and the pins can no longer take place and static friction is involved rather than dynamic friction. In the metering situation shown in FIG. 3 the speed of the yarn is related to the diameter ($d$) of the hub portion 12 (or equivalent), the thickness ($t$) of the yarn and the number (N) of revolutions per minute of hub portion 12.

If $d$ is in meters the yarn speed S in meters/minute is approximately given by the expression:

$$s = N\pi (d + t) \text{ secant } \theta$$

FIG. 6 is a plot of yarn speed(S) against yarn output tension ($T_o$) from the element for a variable demand situation. The flat part of the plot shows the positive grip situation discussed above. It will be noted that in this mode of operation the yarn speed is independent of output tension provided that this exceeds some critical value ($T_c$). For tensions below $T_c$ of course the yarn will slip backwards against the direction of rotation relative to the element. This is reflected in the sloping part of the plot.

The formula for Ti/To is derived on the assumption that $T_o = T_c$ (i.e. at point A on the graph). For the sloping part BA of the graph $Ti/To > e^{2\mu 2^{n\theta}}$ whilst for the flat part $Ti/To < e^{2\mu 2^{n\theta}}$ where $Ti/Tc = e^{2\mu 2^{n\theta}}$ at point A on the graph and $\mu_2$ is the coefficient of static friction between the pin and yarn.

Reducing $T_i/T_o$, that is increasing $T_o$ or reducing $T_i$ moves the operating point toward C — the element becomes more positive. Increasing $T_i/T_o$, that is reducing $T_o$ or increasing $T_i$ effectively moves the operating point towards B — the element will be less positive. Increasing $\mu_2$, $n$ or $\theta$ will increase the critical value of $T_i/T_c$. This is, for any fixed input, $T_c$ is reduced, moving point A to the left thus making the element positive at lower output tensions than previously.

Thus it will be seen that point A (and the tension T) can be chosen in the design of the element by adjusting the frictional characteristics of the assembly. Increasing the total yarn-pin contact angle or the static coefficient of friction, moves point A to the left and allows for the output tension at which slippage occurs to be decreased to a required value.

By choosing design and operating conditions, point A can be moved to the right so that slippage occurs at higher output tensions. For example, point A can be made to correspond to an output tension of say 10 grams. Any yarn demand of a lower speed than that supplied by the element at point A will correspond to an output tension lower than 10 grams. In this way an input tension can be reduced by the element. If in addition the device is speeded up relative to the same yarn demand, the output tension will reduce still further and the possibility of reducing ("breaking" ) an input tension to a required output tension, by varying the speed of the element, is evident.

The means is thereby available for obtaining a required output tension by adjusting the rotational speed of the element. For example, high tensions off knitting packages, or through creels (where there are a large number of yarn/metal, yarn/ceramic contacts) can be converted to "knittable" levels.

Increasing the total yarn-pin contact angle can be accomplished by:

1. increasing the number of pins by:
   a. increasing the density of pins on the periphery which increases $\theta$ and $n$;
   b. increasing the diameters of the hub portion (and retaining the pin density) which increases $n$;
   c. increasing the yarn wrap on the hub portion which increases the number of yarn contact points.
2. increasing the diameter of the pins, which increases $\theta$. Input tension to the device has a relatively small effect on the position of point A.

By the appropriate choice of design and operational conditions it is possible to arrange for the device to slip at only very low output tensions and specifically when there is no yarn demand at all and output tension is zero, but to drive positively when the yarn demand and tension rises to correspond with point A.

In this way intermittent positive feed drive is practicable. Whilst the machine is demanding yarn the element is controlling the rate of supply. When the demand ceases, the element continues to rotate but zero yarn tension ensures slippage between yarn and pins, and no feed occurs.

Suppose for example that it is desired to design an element in accordance with the present invention for use with a conventional industrial knitting machine. The necessary yarn speed when the machine is operating under full load will be known (or can be measured) and the rotational speed of the element can be adjusted in proportion to this to give the required height of the flat part of the graph in FIG. 6. A couple of trial elements are next tried with the yarn or yarns to be used to allow the coefficients of yarn/element friction to be deduced. Then knowing how the input tension to the knitting machine is to vary in practice the element can be designed to give the yarn slip part of the graph the desired slope. As already mentioned, the formulae quoted earlier are not exact but they nevertheless allow a satisfactory element to be arrived at. Adjustments can be made when the element is in position by altering the input and/or output points to the element so that a greater or lesser number of pins are involved in defining a guide path for the yarn. Dotted line 15' in FIG. 1 illustrates one such alternative path for the yarn. In this way more or less optimum operating characteristics may be arrived at in any particular case.

As already indicated, a typical application of the control element would be in its use with an industrial knitting machine where the performance characteristics of the element allow exactly the right amount of yarn for controlled stitch formation to be supplied to the knitting elements thereby maintaining the quality of the knitting fabric. In particular the element has been satisfactorily used in a Jacquard machine with differential feed.

Apart from industrial knitting machines, however, the invention may well have other important applications right outside this field e.g. for servo stabilisation of tensions or for tension sensing with a connected modulated speed control.

It will be clear from the above that the element of the present invention offers very real and important advantages over currently available yarn feed mechanisms. Moreover nothing is known of any already available commercial products giving the continuous control of tension which the proposed device can achieve and the facility of obtaining near zero output tensions.

Comparable reductions in tension are only achieved by storage devices, possibly the best known of these being the I.R.O. type which provides a fixed output tension (regulated in discrete steps by replacement friction rings) from any input tension. The element of the present invention, however, is instantly and continuously variable without component modification via its speed and provides a continuous, rather than a storage, facility.

Components presently used in quantity in the knitting industry which superficially resemble the proposed element are various forms of rotating tensioners e.g. on sewing machines and as hysteresis brake tensioners. With these, the thread is positively mechanically gripped between two surfaces and relative movement between yarn and tensioner periphery is undesirable. The length of yarn path in the tensioner at any one wrap angle tends to vary with yarn tension as the yarn is pulled further into the grip under tension increase (i.e. there is not positive rate between yarn path and rotational speed). The yarn rotates the tensioner which in turn is braked by a suitable pad, or magnetically, to *increase* the output tension above the input tension. These tensioners are *not driven* and are not intended to allow slippage between yarn and periphery.

Although "yarns" have been referred to extensively throughout this specification, it will be understood that devices according to the present invention work equally well with other like materials e.g. threads, filaments, lengths of rubber or other tension sensitive materials, metal wires etc. It is even envisaged for example that the element of the present invention might be used to feed rigid or semi-rigid articles such a metal rods or tubes if the pins or their equivalent are displaceable in directions perpendicular to the reference plane of the element e.g. by having them made of a suitably flexible material such as spring steel. In one such embodiment, the element is of exactly the same configuration as the embodiments shown in FIGS. 1 and 2A except that, as already mentioned, the pins 14 are flexible.

Referring now to FIG. 7, the accompanying drawing shows a part cut-away of a particular embodiment of a rigid control element formed by injection moulding e.g. from the material marketed by Courtaulds under the trade name "Dexel." The element comprises a hub portion 100 carrying at its periphery a number of "teeth" 102. The inner faces 104 of these teeth present respective guide surfaces staggered about an imaginary reference plane (in this case the mid plane of the element) which is perpendicular to the axis of rotation of the hub portion 100. These surfaces define for the material to be controlled. e.g. yarn 105, a zig-zag path which degenerates with increasing distance from the axis of rotation X — X of the element into a line path lying in the reference plane of the element. Advantageously, the yarn-contacting parts of the teeth will prevent the same form of guide surfaces to the yarn as those presented to the yarn by the pins 14 in the first embodiment.

Two guard rings 108, 110 (for alternate sets of teeth) strengthen the element and also reduce the risk of the teeth causing damage during rotation of the element.

FIG. 2B shows a currently preferred embodiment in which the element has a hub diameter of 70 mm with 32 pins of circular cross-section, diameter 2 mm, having their root portions in line and equally spaced about the periphery of the hub. The yarn contacting surfaces of the pins are curved away from the central plane 18 on a radius of 30 mm with their root portions entering the hub normal to its peripheral surface. If desired the pins could be replaced by teeth the yarn-contacting portions of which are identical to the yarn-contacting portions of the pins shown in FIG. 2B. The element can then be injection moulded in exactly the same way as above described with reference to the embodiment shown in FIG. 7. FIG. 2C shows this modification which when viewed in perspective will in fact look substantially the same as the embodiment shown in FIG. 7 except that the circular cross-section parts of the root portions of the teeth are no longer staggered.

FIG. 2D shows a control element in which the guide surfaces are provided by a drum member 150 with suitably contoured peripheral surfaces. Broadly speaking the guide surface in this case will take the form of a zig-zag channel 151 widening with increasing distance from the axis of rotation XX of the control element.

The design technique and the mode of operation of these elements is identical to that described above with reference to FIGS. 1 to 2A, 3–6 and will not be elaborated on here.

In all the described embodiments, the amount of "wrap" around the element can, if desired, be manually controlled by a cylindrical bar arranged across the yarn and displaceable in a direction perpendicular to the direction of movement of the yarn and to the axis of the bar. Such a unit is shown by way of example in FIG. 7 at 112. Reference numerals 114 and 116 indicate the bar and a pivot allowing its displacement in the desired fashion. An alternative, and preferred, design of adjustment device is shown in FIG. 8. This comprises a guide member 212 consisting of a lightweight arm 224 pivotted at its lower end 220. At its upper end the arm 224 carries an eyelet 222 through which passes yarn leaving a control element 10 of the sort illustrated in FIGS. 1 and 2A or FIG. 7. Reference numerals 216 and 218 indicate fixed guide eyelets through which the yarn 14 passes in its journey around the control element and "$\gamma$" represents the "angle of wrap. "

In operation, if there is a reduced output yarn demand, yarn tension falls since the control element 10 is feeding yarn at a positive rate in excess of that at which yarn is being taken.

The reduction in tension allows arm 224 to drop under gravity, modifying the yarn path (as indicated by the dotted line 214) and substantially reducing the angle of wrap of the yarn around the periphery of control element 10. This reduction in wrap reduces the frictional grip of the element on the yarn and causes the yarn to slip relative to element 10 through the latter continues to rotate at its positive feed rate.

In the variation of FIGS. 9 and 10, the single guide member 212 of the FIG. 8 embodiment is replaced by two such members 230, 232 each pivoted coaxially with the control element 10. A stop 234 is provided for the arm of the lefthand guide member 230. In this arrangement, a sufficient reduction in output tension results in both guide members dropping under the action of gravity, the first to the stop 234 and the second to a vertical position as shown in FIG. 10. The modified yarn path is such that there is substantially no engagement between the yarn and the element 10. A return of tension lifts both guide members back to the "yarn engaged" position in which the yarn is again under the control of element 10.

The adjustment devices of FIGS. 8 to 10 have a particular application in half hose machines which reciprocate their action from say clockwise to anticlockwise rotation at certain points in the production cycle. In order to regulate slippage around the control element when yarn demand is low or absent in such machines e.g. at the reversing points in the reciprocating action, one of the two systems above described in accordance with the present invention can be used.

Referring now to FIG. 11, this shows in diagrammatic and much simplified form, the layout of a conventional V-bed knitting machine 310. This comprises a carriage 312 arranged to move on rails (not shown) over a bed 314 of knitting needles. FIG. 11 shows the carriage 312 at the lefthand extreme A of bed 314. The yarn 316 to be knitted is fed from a package 318 via a pulley 320 at the righthand end B of the bed 314 to a feeder 322 running on rails parallel to those for carriage 312. Whereas the carriage 312 moves from one end of the bed 314 to the other, the feeder 322 only moves over the portion 324 of the bed selected for knitting the particular garment concerned. It will be seen that the feeder 322 is at the lefthand extreme C of bed portion 324. Reference letter D indicates the righthand extreme of portion 324.

In operation of the machine, beginning from the situation shown in FIG. 11, the carriage 312, moving rightwardly, engages the feeder 322 at point C and moves it over the selected needles comprising portion 324 of the bed. When the feeder reaches point D, it disengages from the carriage 312 which continues alone towards the righthand extreme B of the bed 314. At point B, the carriage 312 reverses direction and moves back to point A. In so doing the carrier 312 moves the feeder 322 back over the selected needles to point C in readiness for the next excursion of carriage 312.

Although the demand (X) for yarn by the needles in bed portion 324 is the same irrespective of the direction in which the feeder is travelling, the demand for yarn by the feeder is greater when it is moving in direction DC than it is when it is moving in direction CD. This stems from the fact that the distance of feeder 322 from pulley 320 alternately increases and decreases during operation of the machine. In moving from point C to point D, for example, the yarn demand of feeder 322 is X-CD; in other words amount CD of the required yarn is already available and need not be fed round pulley 320. In moving from point D to point C, on the other hand, the yarn demand of feeder 322 is X + CD; in other words, in addition to the yarn demand by the needles, the extra length of yarn necessitated by the increased distance of the feeder from pulley 320 must also be fed round the pulley 320.

This difference in feeder yarn demand dependant on the direction in which the feeder happens to be moving may result in a corresponding difference in tension in the yarn fed to the needles in bed portion 324. Thus the tension of the yarn in rows knitted when the feeder is moving from left to right tends to be less than those knitted when the feeder is moving from right to left. It is desirable to eliminate the yarn rate differences at pulley 320 and any differences in yarn tension, especially if the yarn is to be fed through one of the yarn control elements above described in accordance with the present invention.

Although the yarn rate differences can be reduced by moving pulley 320 to a more central position e.g. midway between points C and D, the problem cannot be eliminated in this way and a constant rate demand at the selected needles will still result in an irregular rate of yarn supply to the feeder.

Referring now to FIG. 12 it will be seen that the machine of FIG. 11 has been modified to include a satellite carriage 330 and in place of pulley 320, a control element 420 in accordance with the present invention. In most other respects the machines of FIGS. 11 and 12 are essentially the same. The same reference numerals have been used in the two Figures for corresponding parts.

Thus in FIG. 12, the yarn 316 is fed from a control element 420 to the feeder 322 via a pulley 332 carried by the satellite carriage 330 on the other side of carriage 322 to element 420 which can be arms of the forms above described with reference to FIGS. 1 to 10. Element 20 provides, in this embodiment, the yarn delivery point above referred to. The satellite carriage 330 carries a second pulley 334, and a flexible substantially inextensible elongate drive element 336, secured at one end (338) to feeder 322, passes round pulley 334 to be secured at its other end 340 to a fixture 342 which could, for example, be the righthand end B of bed 314. A tensator spring (not shown) urges the satellite carriage 330 to the left. This keeps element 336 taut during right-to-left motion of the satellite carriage.

In operation, starting from the situation shown in FIG. 12, the carriage 312 will move to the right and sweep feeder 322 over the bed section CD as already described with reference to FIG. 11. The satellite carriage 330 is mounted on rails (not shown) and during movement of feeder 322 to the righthand end of the track, it will be pulled behind feeder 322 by the flexible element 336. The fact that element 336 passes around a pulley on the satellite carriage means of course that this latter will only move at half the speed of feeder 322. When the feeder is moved to the left during the return journey of carriage 312, the tensator spring ensures that the satellite carriage also moves in this direction although once again the presence of pulley 334 and element 336 will ensure that the satellite carriage moves at only half the speed of feeder 322.

It will be clear from the lay-out of the system illustrated in FIG. 12 that the path of the yarn downstream of element 420 is of the same geometric form as the flexible element 336 so that variations in the path length of the yarn downstream of element 420 could not occur because these would require corresponding and equal changes in the length of the inextensible element 336. Expressed in another way, the path length of the yarn downstream of element 420 differs from the length of the inextensible element 336 only by a constant (which may be zero) and which takes account of any difference in the circumferences of pulleys 332, 334 and of any vetical non-alignment of pulleys 332, 334, or points C, 338, or element 420 and end 340 of the drive element.

Thus yarn fed to the selected needles from package 318 moves along a path which neither increases nor decreases in length during operation of the machine. It follows that the tension in the yarn being fed to the needles will be unaffected by the direction of movement of the feeder and will be the same for rows knitted from left to right as it is for rows knitted from right to left.

In an alternative embodiment (not shown), the path of the satellite carriage 330 overlaps part of bed portion 324. Conveniently, in this case, the satellite carriage 330 and feeder 322 both begin their left to right movements from the same position C.

Although the various Figures of the drawings show the control elements being used singly, they can, if desired, be grouped in banks to control a corresponding number of yarns.

We claim:

1. A rotatable control system for yarn or like material comprising in combination:

an element having an outer cylindrical peripheral surface extending substantially parallel to said element's axis of rotation, said surface being accessible to the yarn to make continuous contact therewith for the length of yarn along the surface, said surface having a number of discrete guide surfaces, at least in part, staggered about an imaginary reference plane which is perpendicular to said axis of rotation of said element, alternate ones of said number of said discrete guide surfaces providing a first set of such surfaces each of which bend only in a first direction relative to said reference plane, and the intervening ones of said guide surfaces providing a second set of said surfaces, each of which bends only in the opposite direction to said first direction, the divergence of adjacent surfaces relative to said reference plane increasing with increasing distance from said axis of rotation to define, for the material, a zig-zag path which degenerates with increasing distance from said axis of rotation of said element into a line path lying in said reference plane of said element; and control means for varying the distance of the yarn from said element axis of rotation to thereby vary the tension applied by said element as it is rotated including first and second guide members pivotably mounted about said axis of rotation and each mounting means for guiding passage of said yarn.

2. A system as in claim 1, wherein said means comprises first and second guide member pivotably mounted for rotation about said axis of rotation and each yarn guidance means is an eyelet through which yarn passes.

3. An system as claimed in claim 1 in which the guide surfaces are provided by projections extending from a hub portion of the device.

4. An system as claimed in claim 3 in which the projections are of circular or part circular cross-section.

5. An system as claimed in claim 3 in which the projections take the form of rods.

6. An system as claimed in claim 3 in which the projections take the form of "tooth"-like projections.

7. An system as claimed in claim 1 in which the guide surfaces are provided by a drum member and take the form of a zig-zag channel widening with increasing distance from the axis of rotation of the control element.

8. A system as in claim 1, wherein said control means comprises a cylindrical bar extending substantially parallel to said axis of rotation and means for mounting said bar for displacement perpendicular to the direction of movement of the yarn and to the bar axis.

9. A system as in claim 1, including means for rotating sad element about said axis of rotation.

10. A rotatable control system for yarn or like material comprising in ccmbination:

an element having an outer cylindrical peripheral surface extending substantially parallel to said element's axis of rotation, said surface being accessible to the yarn to make continuous contact therewith for the length of yarn along the surface, said surface having a number of discrete guide surfaces, at least in part, staggered about an imaginary reference plane which is perpendicular to said axis of rotation of said element, alternate ones of said number of said discrete guide surfaces providing a first set of such surfaces each of which bend only in a first direction relative to said reference plane, and the intervening ones of said guide surfaces providing a second set of said surfaces, each of which bends only in the opposite direction to said first direction, the divergence of adjacent surfaces relative to said reference plane increasing with increasing distance from said axis of rotation to define, for the material, a zig-zag path which degenerates with increasing distance from said axis of rotation of said element into a line path lying in said reference plane of said element; and control means for varying the distance of the yarn from said element axis of rotation to thereby vary the tension applied by said element as it is rotated including:

a guide member pivoted on one end, and means for guiding said yarn after leaving said control element attached to the other end of said guide member so that the position of said guidance means and member vary as a function of the tension in said yarn to vary the distance between the yarn and said element axis.

* * * * *